US005122076A

United States Patent [19]

Pitts

[11] Patent Number: 5,122,076

[45] Date of Patent: Jun. 16, 1992

[54] DATA CONNECTOR LOCKING MECHANISM

[75] Inventor: Terry L. Pitts, Greensboro, N.C.

[73] Assignee: AMP Incorporated, Harrisburg, Pa.

[21] Appl. No.: 590,879

[22] Filed: Sep. 28, 1990

[51] Int. Cl.[5] ..... H01R 13/627

[52] U.S. Cl. ..... 439/352; 439/347; 439/372

[58] Field of Search ..... 439/345, 350, 347, 352, 439/353, 354, 357, 355, 372, 552, 555, 557

[56] References Cited

U.S. PATENT DOCUMENTS

| | | | |
|---|---|---|---|
| Re. 32,760 | 10/1988 | Chandler et al. | 439/188 |
| 4,201,437 | 5/1980 | Lockyer | 439/555 X |
| 4,711,507 | 12/1987 | Noorily | 439/557 X |
| 4,711,511 | 12/1987 | Noorily | 439/437 |
| 4,950,179 | 8/1990 | Takenouchi et al. | 439/357 X |

FOREIGN PATENT DOCUMENTS 0026703 9/1980 France .

OTHER PUBLICATIONS

AMP's Instruction Sheet, IS-3110, Jan. 6. 1989.

IBM Technical Bulletin, vol. 32, No. 6A, Nov. 1989.

*Primary Examiner*—Larry I. Schwartz

*Assistant Examiner*—Khiem Nguyen

[57] ABSTRACT

A hermaphroditic data connector is disclosed herein having latching members integrally connected to a connector body via a molded web of material thereby forming a hinge for the latching members. The forward end of the latching members include latching mechanisms thereon for mated interconnection with a like connector. A locking mechanism is insertable over the latching mechanisms to lock the latching members in place. The locking mechanism includes side walls which flank side edges of the latching members and an upper wall which extends over the latching members. The locking mechanism further includes bars extending integrally from the side walls of the locking member, and are positioned intermediate the latching members and the connector housing. The locking mechanism is movable between locked and unlocked positions.

25 Claims, 9 Drawing Sheets 28
26
36
34
38
40

2
8
14
6
16
42
44
10
4
20
26
28
30
30
28
22
24

26
28
20
34
3
3
36
40
22
28
24

DATA CONNECTOR LOCKING MECHANISM

BACKGROUND OF THE INVENTION

1. Field of the Invention

The invention relates to electrical connectors for use in terminating shielded multiconductor cables and more specifically to a data connector having a locking mechanism for locking the data connector in a latched configuration.

2. Description of the Prior Art

U.S. Pat. No. RE32,760 discloses a local area network connector specifically intended for use in the data communications industry. These connectors can be employed in a closed loop data communications link in which various equipment, such as computer terminals, can be interconnected in a system. These connectors are specifically adapted for use in interconnecting numerous micro- or mini-computers in a computer network in an office environment. Connectors of this type have standard interface dimensions and configurations.

There exists within the industry, a need for retaining such electrical connectors in a latched configuration with other electrical connectors when connected. In particular, the connectors need to be held in a latched configuration with electrical connectors mounted in a patch panel, so-called panel mounted connectors, where a plurality of electrical connectors are positioned in a common panel for cross connect between various locations.

In the connector assembly shown in U.S. Pat. No. RE32,760, a discrete locking member is available which is movable laterally between the latching arms and the top of the housing, filling the void between the latching arms and the housing on both sides of the integral web forming the hinge, thereby preventing the pivotal movement of the latching arms while the locking member is in place.

Another embodiment of locking mechanism is shown in U.S. Pat. No. 4,711,511 wherein each latching arm includes a locking bar between the pivotal arm and the housing and is longitudinally movable to perform a wedgelike function thereby preventing the pivotal movement of the latching arms when the locking bars are in the fully forward position.

DETAILED DESCRIPTION OF THE PREFERRED EMBODIMENT

Figures 1, 2, 3:
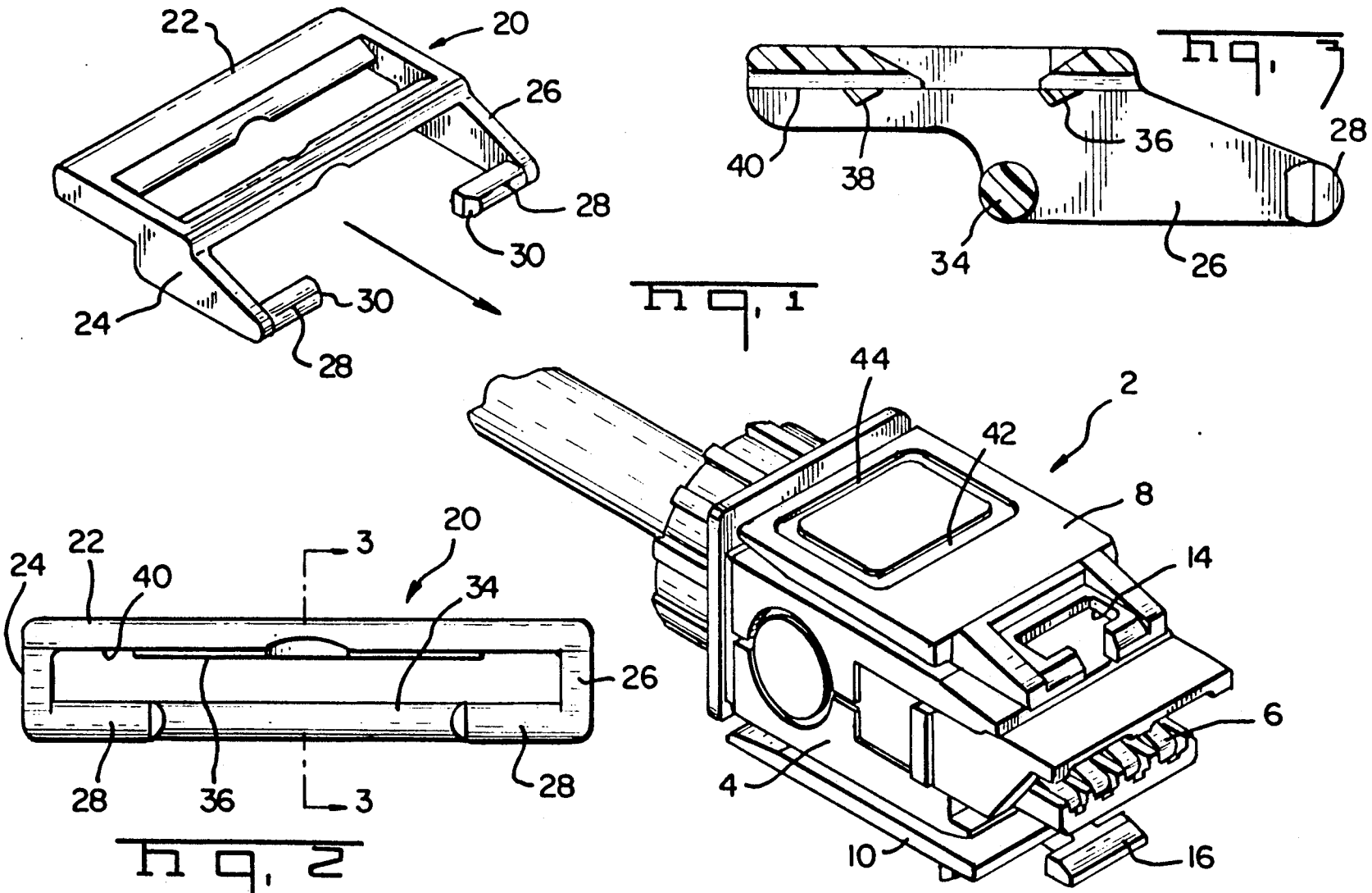
FIG. 1 is an isometric view of an electrical data connector showing one of the locking members exploded from the rear thereof.
FIG. 2 is a front elevational view of the locking member shown in FIG. 1.
FIG. 3 is a cross-sectional view through lines 3—3 of FIG. 2.

With reference first to FIG. 1, a data connector is shown generally at 2 which is of the type generally shown in U.S. Pat. No. RE 32,760, incorporated herein by reference. The data connector includes a central body portion 4 having a plurality of electrical contacts 6 adjacent to a front mating face where the contacts 6 are reversely bent for interconnection with like contacts in a corresponding hermaphroditic connector. Connector 2 includes an upper latch member 8 and a lower latch member 10 where each of the latch members 8 and 10 are pivotal relative to the central body portion 4 by means of an integral web of material 12 (FIG. 4) thereby forming a hinge. The latch member 8 includes a C-shaped slot 14 whereas the latch member 10 includes a T-shaped bar 16 where the C-slot 14 is adapted to receive a T-bar 16 of a corresponding connector when the front face of the corresponding hermaphroditic connector is rotated 180° about a longitudinal axis.

As shown now in FIG. 1, the data connector further comprises a locking latch shown generally at 20 comprising an upper wall portion 22 profiled to span the latch members 8 and 10 of the data connector, that is, side wall portions 24 and 26 are adapted to flank side edges of the latch members 8 and 10. The locking latch 20 includes two locking bars 28 extending from the side walls 24 and 26 where the bars extend only part way between the two side walls, the two bars 28 being spaced apart a distance less than the width of the hinge 12. The bars 28 include, at their forward ends, ramped surfaces 30 in order that the locking latch 20 can be moved forwardly to a position where the ramps 30 contact the outer edges of the hinge 12 thereby flexing the side walls 24, 26 outwardly to a position where the bars 28 pass the hinge 12 and thereafter resiliently snap back to a position where the bars 28 are longitudinally beyond the hinge 12.

As shown best in FIG. 2, the locking latch 20 further comprises a lower surface 40 for bearing engagement against an upper surface of either the latch member 8 or 10 as will be described in greater detail herein. The locking latch 20 also comprises a cylindrical bar 34 extending continuously between the opposite side walls 24 and 26. With reference now to FIG. 3, the upper wall 22 includes a forward detent 36 and a rearward detent 38 extending downwardly from the lower surface 40 of the upper wall 22. The detents 36 and 38 cooperate with the transverse recessed slots 42 and 44 in the upper surface of the latching members 8, 10 (FIG. 1) as will be described in greater detail herein.

Figure 4:
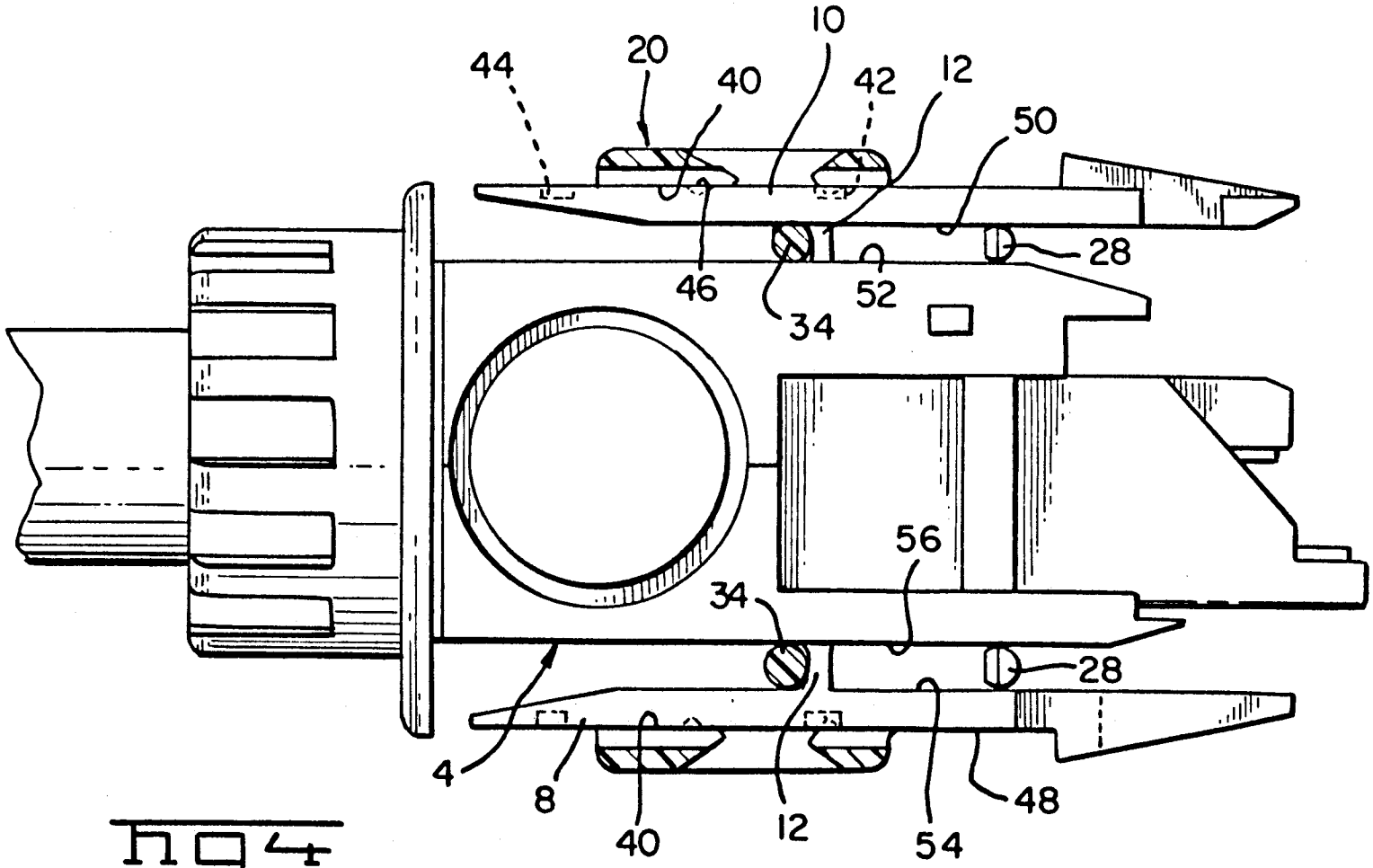
FIG. 4 is a side elevational view showing the locking mechanism in cross-section installed on the data connector.

With reference now to FIG. 4, as positioned on either the latch member 8 or 10, the locking latch 20 has its lower surface 40 adjacent to an upper surface 46 of the latch member 10 and adjacent to surface 48 of latch member 8. Both the bars 28 and the cylinders 34 are positioned intermediate lower surface 50 of the latch member 10 and the upper surface 52 of the central body portion, whereas the opposite locking latch 20 is positioned intermediate lower surface 54 of the latch member 8 and between surface 56 of the central body portion.

Figure 5A:
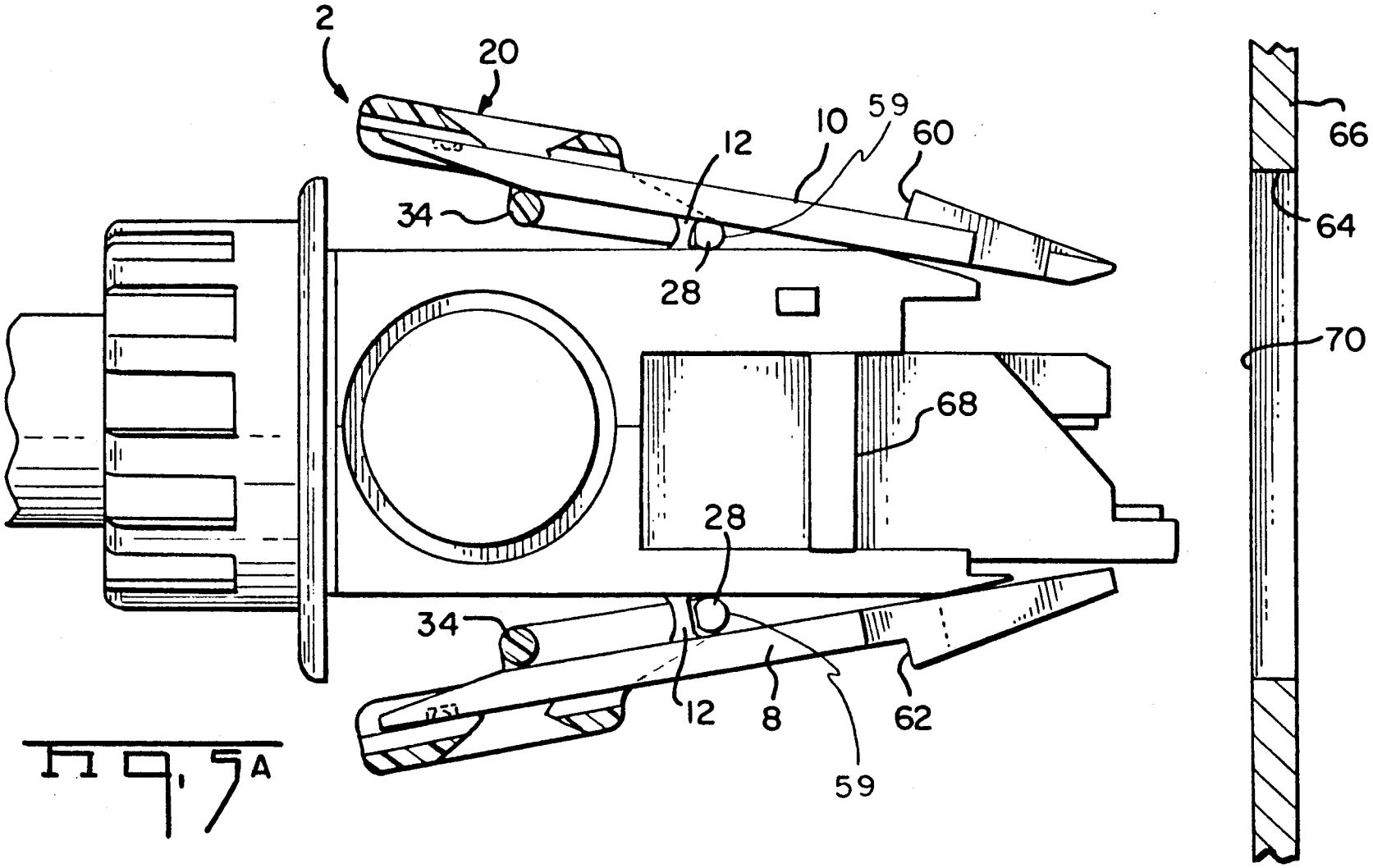
FIG. 5A shows the locking member in a position allowing the latching members to be pivoted towards the data connector for insertion in a panel opening.

With reference now to FIG. 5A, the locking latches 20 are movable to their rearwardmost position where the bars 28 abut the hinge 12. In this position, the latching members 8, 10 and the locking latches 20 are pivotal together about the hinge 12, the bars 28 of the locking latch 20 having a radiused surface 59 allowing the bars 28 to pivot against the housing. The latching members 8, 10 pivot to a position where the locking shoulders 60 and 62 on the latch members 10 and 8, respectively, clear an opening 64, such that the connector is insertable through the opening 64 of the panel 66. The connector 2 is insertable into the opening 64 to a position where side edges 68 of the central body portion abut a side edge 70 of the opening 64. At this position, the latch members 8 and 10 can be released whereby the latching shoulders 60 and 62 resiliently spring back to their normal position and abut the front surface of the panel 66.

Figure 5B:
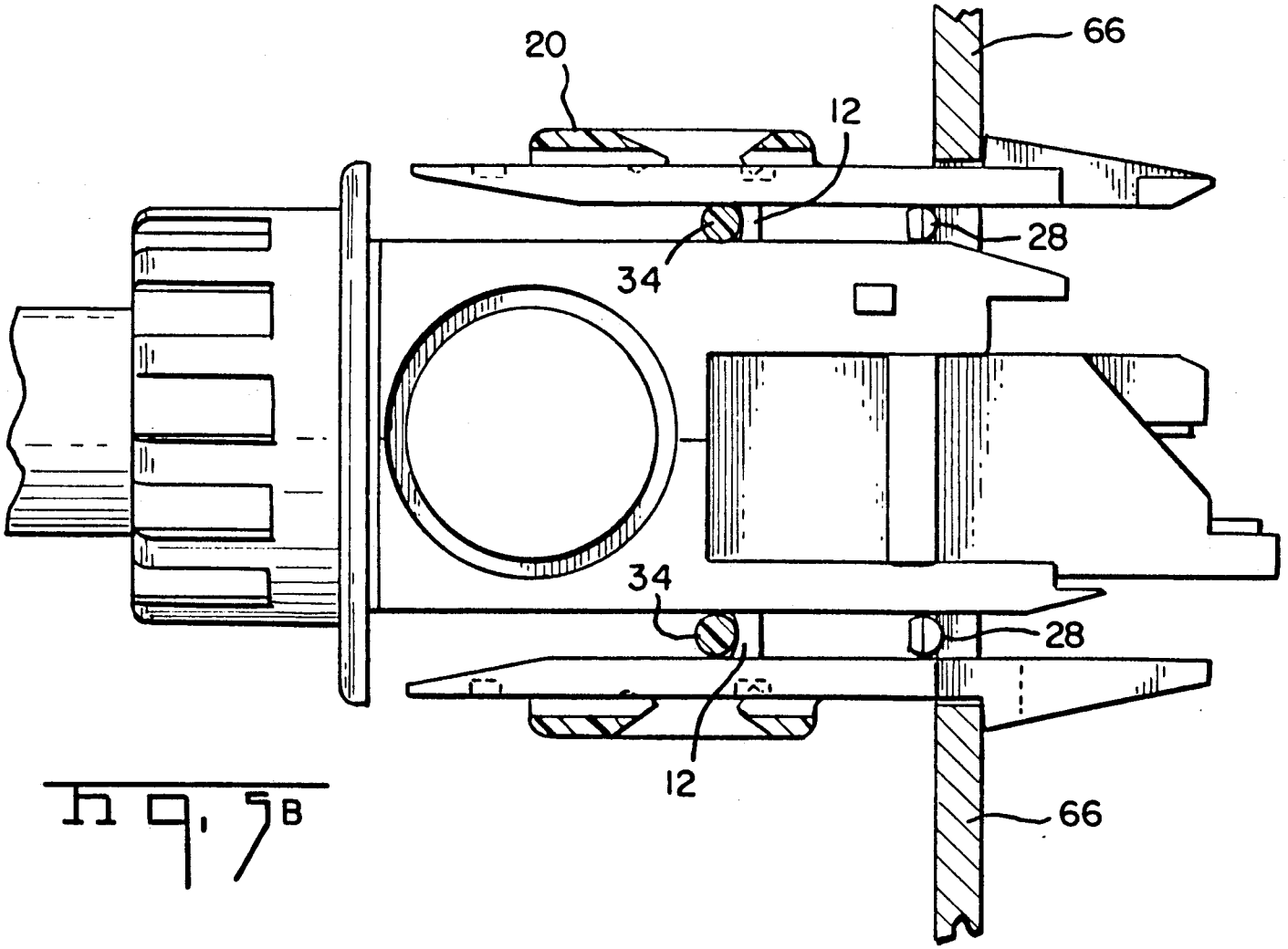
FIG. 5B is a view similar to that of FIG. 5A showing the data connector inserted in the panel opening and the locking mechanism in a position preventing the disconnection of the data connector from the panel.

With reference now to FIG. 5B, the locking latch 20 is now movable forwardly to a position where the rod 34 abuts the back side of the hinges 12 thereby placing the bars 28 forwardly of the hinges 12. The bars 28 thereby prevent downward movement of the latch members 8 and 10 preventing disconnection of the connector 2 from the panel 66.

Figure 6A:
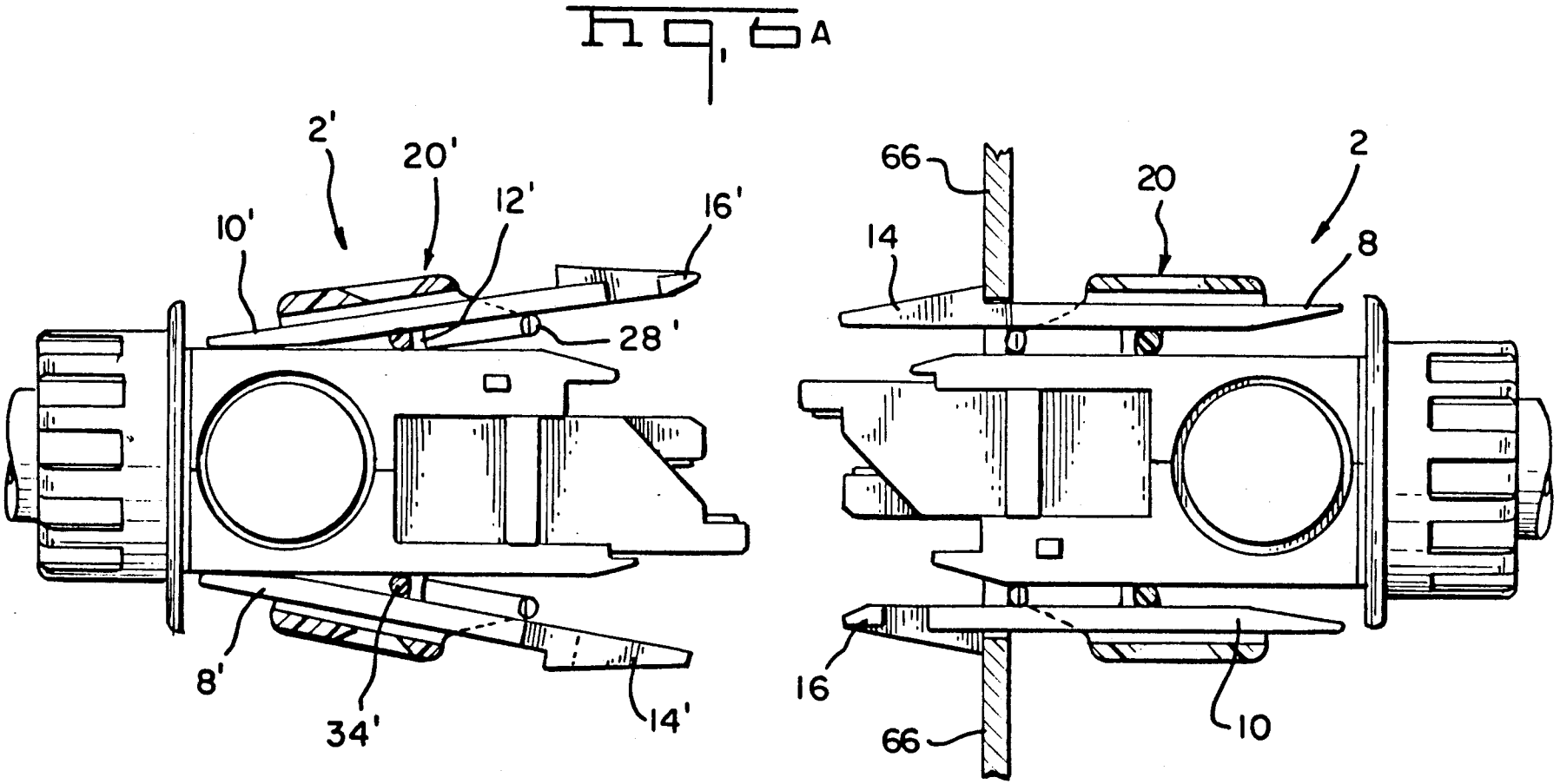
FIG. 6A shows a mating data connector poised for receipt within the data connector positioned in the panel with the locking mechanism in a position allowing the latch members to be pivoted outwardly for receipt within the mating data connector.
Figure 6B:
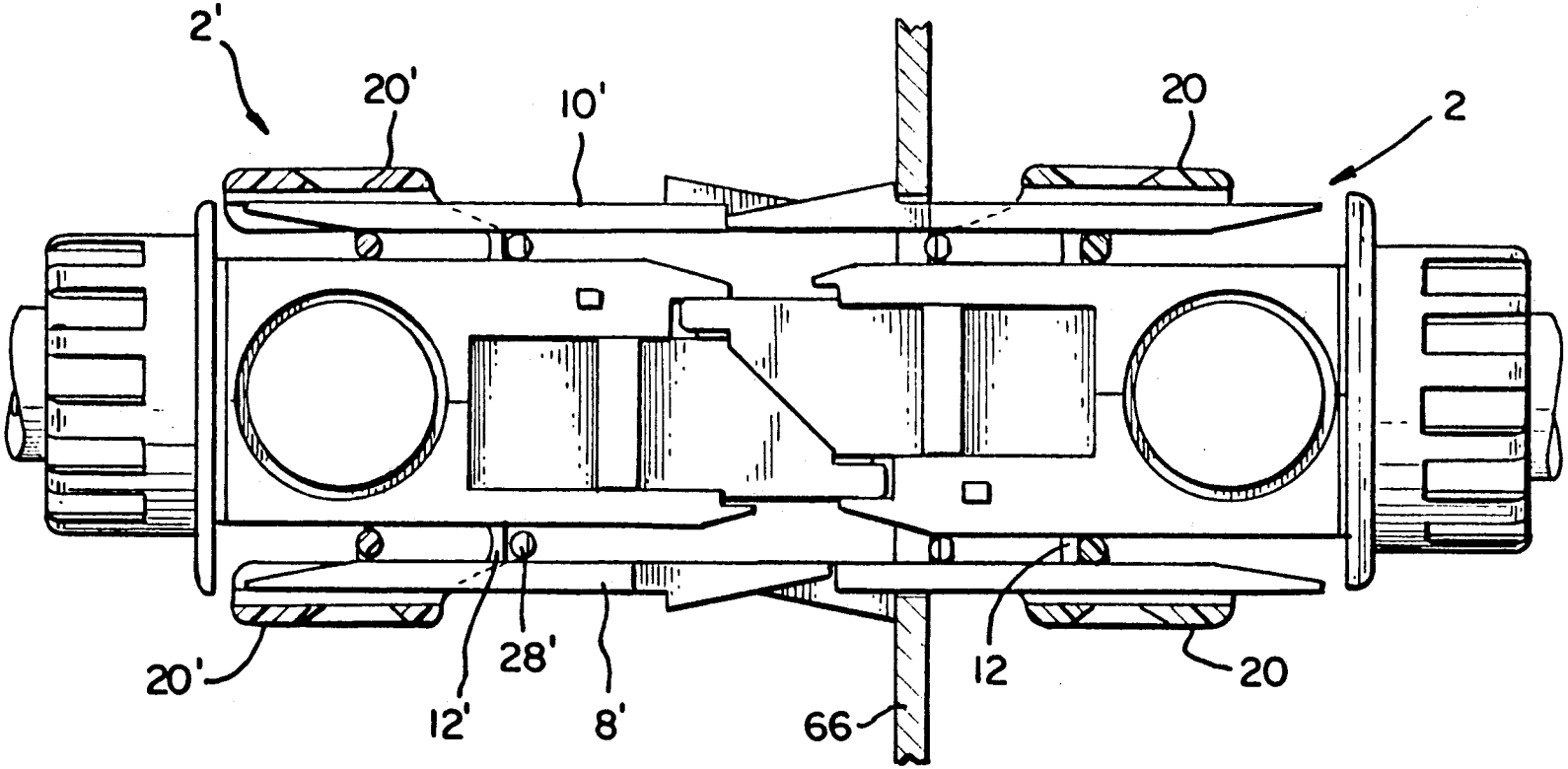
FIG. 6B shows the two data connectors in mated engagement with the locking mechanism in a position preventing the disconnection of the two connectors.

With reference now to FIG. 6A, the data connector 2 is shown in the locked configuration within the panel 66 and poised for receiving an identical data connector 2'. With the locking latch 20' fully forward such that the cylindrical rod 34' abuts the hinges 12', the latches 8' and 10', and the locking latches 20', are pivotal about the hinges 12' to position the T-bar 16' in registration with the corresponding C-slot 14 and the C-slot 14' in registration with the T-bar 16 for mating interconnection. As shown in FIG. 6B, when the two data connectors 2 and 2' are fully mated, the locking latch 20' is movable to its rearwardmost position where the bars 28' abut the hinge 12' thereby preventing disconnection of the connector 2' from the connector 2.

Figure 7:
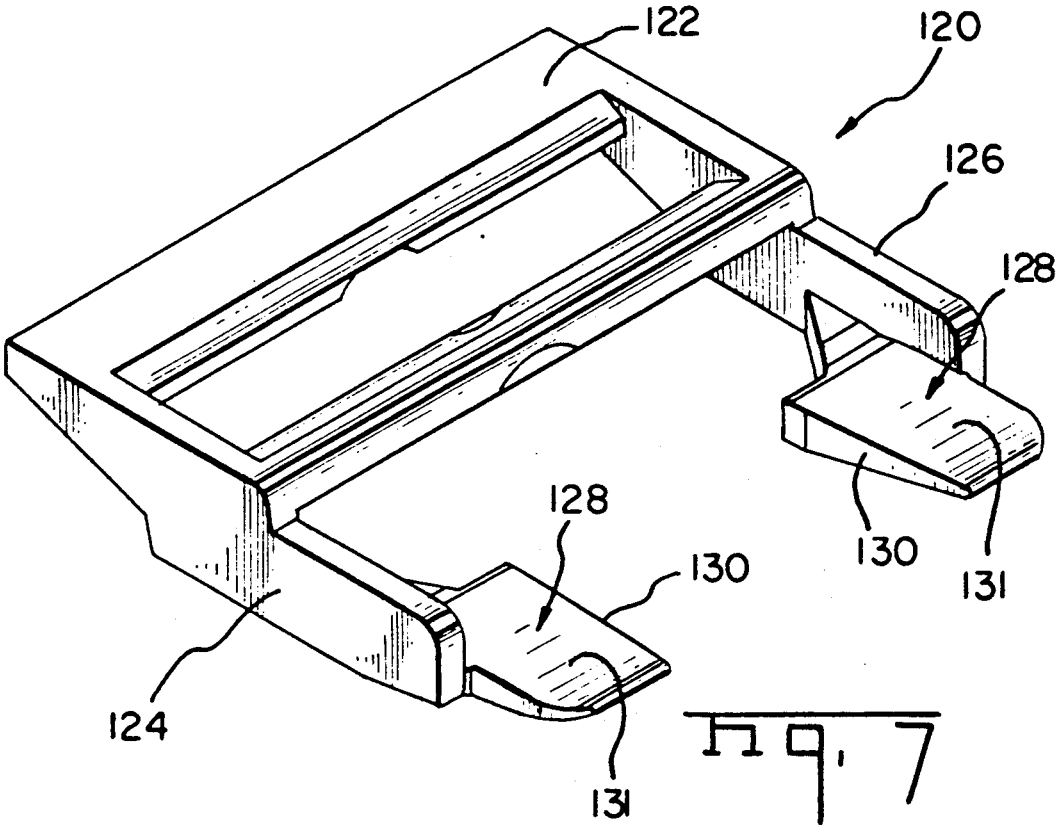
FIG. 7 is a front isometric view of a second embodiment of locking latch.
Figure 8:
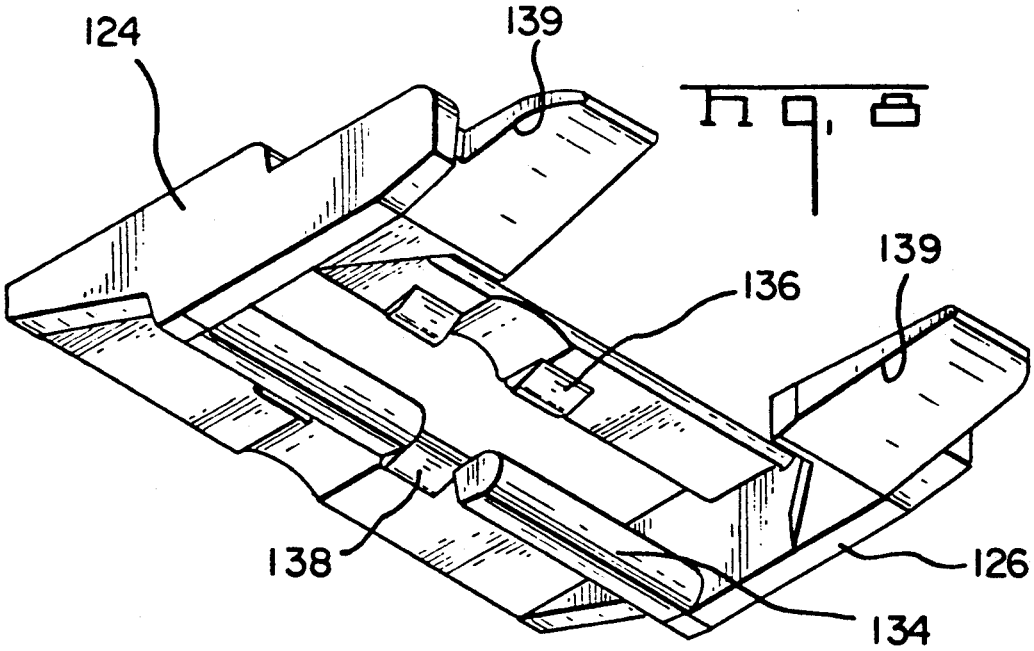
FIG. 8 is a lower isometric view of the second embodiment of FIG. 7.

With reference now to FIG. 7, a second embodiment of locking latch is shown at 120 comprising an upper wall 122 extending between two sidewalls 124 and 126. Two wedge-like bars 128 extend inwardly from the sidewalls and have inner beveled edges 130 to assist in the insertion of the latch over the hinge 12. The bars 128 also have cantilevered locking arms 131, which will be described in greater detail herein. With reference now to FIG. 8, the lower isometric view shows the underside structure of the locking latch 120. The rear bar 134 is discontinuous, thereby adding greater flexibility to the sidewalls 124, 126 during the insertion of the locking latch over the hinge. In a similar nature to the locking latch 20, the locking latch 120 include detents 136 and 138 having an identical function as the detents 36 and 38 of the locking latch 20.

Figure 9A:
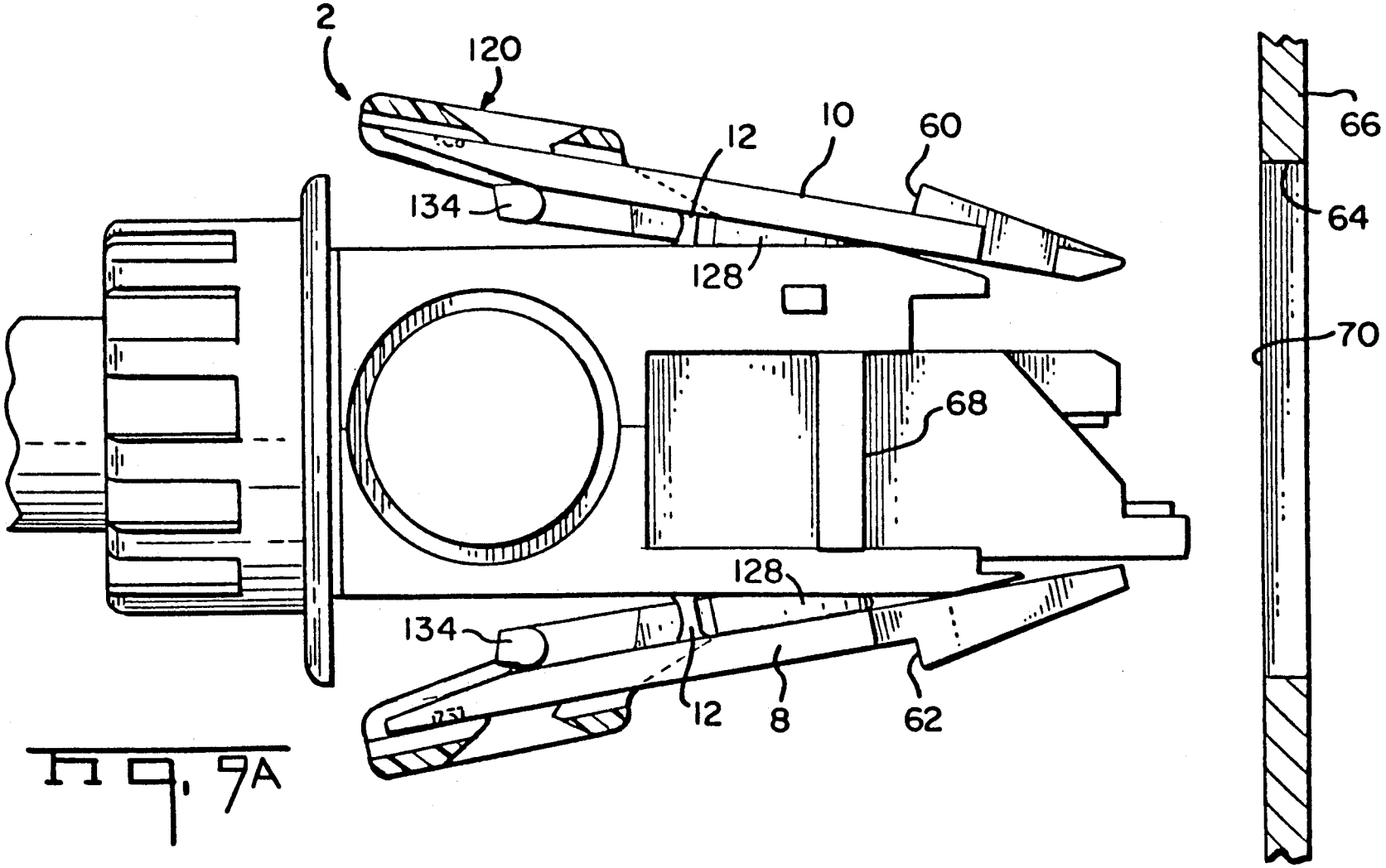
FIG. 9A is a cross-sectional view similar to that of FIG. 5A showing the second embodiment locking latch.
Figure 9B:
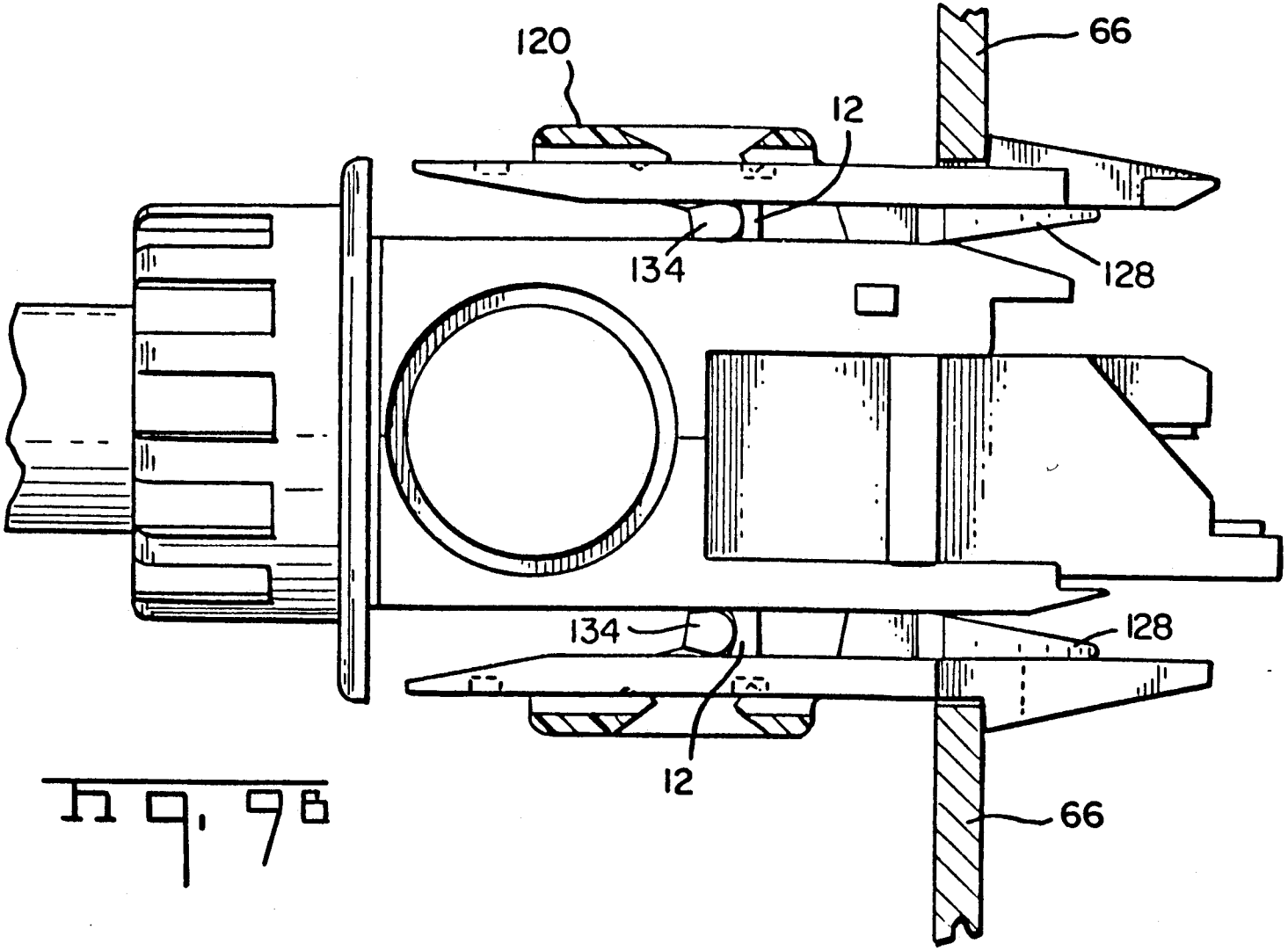
FIG. 9B is a cross-sectional view similar to that of FIG. 5B showing the second embodiment locking latch.

As shown in FIG. 9A, with the locking latch 120 pulled all the way back, the latches 8, 10 are pivotal about the hinge as the cantilevered locking arms have tapered surfaces 139 (FIG. 8) allowing the cantilevered arms 131 to fit within the void created between surfaces 50, 52 of the latch 10, and between the void created between the surfaces 54, 56 of the latch arm 8. When the locking latch is positioned all the way forward however, (FIG. 9B) the cantilevered arms extend forwardly of the sidewalls 124, 126 and help to support the forward ends of the latch arms 8, 10, preventing the inward pivoting of the latch arms 8, 10.

While the forms of apparatus herein described constitute a preferred embodiment of this invention, it is to be understood that the invention is not limited to these precise forms of apparatus, and that changes may be made therein without departing from the scope of the invention which is defined in the appended claims.

What is claimed is:

1. An electrical connector comprising:

an insulative housing having a mating face and a wire connecting face;

latching members integrally connected to opposite side surfaces of said housing, said latching members being integrally connected via molded webs of material medially positioned between ends of said latching members thereby forming hinges for said latching members, one end of each said latching member having a latching mechanism thereon for mating with a complementary electrical connector, while opposite free ends of said latching members are free to move upwardly and downwardly during the pivoting of said latching members;

locking latch means positioned adjacent to each said latching member, comprising sidewalls flanking each said latching member, said locking latch means having integral front and rear bars extending from said sidewalls, and an upper wall positioned in a plane above said bars, said upper wall being positioned above said latching member and said bars being positioned beneath said latching member, said front bars being positioned forward of said hinge and said rear bars being positioned behind said hinge, said locking latch means being movable between a fully rearward position where the front bar abuts said hinge and a fully forward position where the rear bar abuts said hinge.

2. The electrical connector of claim 1, wherein said front bars extend only part way between said sidewalls.

3. The electrical connector of claim 2, wherein said sidewalls are resiliently flexible and said front bars include ramped surfaces on outer edges thereof, whereby said locking latch means may be installed by sliding said locking latch means over said latching members, to a position where said front bars snap beyond said hinge.

4. The electrical connector of claim 1, wherein said front bars are configured as cantilevered arms extending forwardly from said sidewalls.

5. The electrical connector of claim 1, wherein said latching members have front and rear transverse grooves extending into upper surfaces thereof.

6. The electrical connector of claim 5, wherein said upper wall of said locking latch includes detents on a lower surface thereof for engagement with at least one of said grooves.

7. The electrical connector of claim 6, wherein a forward detent resides within said front groove, when said locking latch is in said fully forward position, and a rearward detent resides in said rear groove when said latch is in said fully rearward position.

8. An electrical connector comprising:

an insulative housing having a mating face and a wire connecting face;

latching members integrally connected to opposite side surfaces of said housing, said latching members being integrally connected via molded webs of material medially positioned between ends of said latching members thereby forming hinges for said latching members, one end of each said latching member having a latching mechanism thereon for mating with a complementary electrical connector, while opposite free ends of said latching members are free to move upwardly and downwardly during the pivoting of said latching members;

a locking latch slidably receivable over each of said latching members, said locking latch comprising two sidewall portions having an upper wall spanning therebetween, said latch further comprising a rear cylindrical rod extending integrally between said sidewalls, and a pair of bars extending from opposite sidewalls and facing each other from a spaced apart position, said rod and said bars being located in the same plane which is generally parallel to a plane extending through the upper wall, the locking latch being positioned on each latching member with the upper wall positioned above said latching member, and with said bars positioned forward of said hinge, the locking latch being movable longitudinally between a rearward position where said bars abut said hinge, to a forward position where said rod abuts said hinge.

9. The electrical connector of claim 8, wherein said front bars have a spacing therebetween less than the width of said hinge, and said sidewalls are resiliently flexible to allow said bars to flex beyond said hinge.

10. The electrical connector of claim 9, wherein said bars have ramped lead in surfaces on forwardly facing ends thereof, positioned to engage said hinge upon insertion of said locking latch.

11. The electrical connector of claim 10, wherein said latching members have transverse grooves extending into said surfaces.

12. The electrical connector of claim 11, wherein said upper wall of said locking latch includes detents on a lower surface thereof for engagement with at least one of said grooves.

13. The electrical connector of claim 12, wherein a forward detent resides within a forward groove, when said locking latch is in said fully forward position.

14. An electrical connector comprising:

an insulative housing having a mating face and a wire connecting face;

latching members integrally connected to opposite side surfaces of said housing, said latching members being integrally connected via molded webs of material medially positioned between ends of said latching members thereby forming hinges for said latching members, one end of each said latching member having a latching mechanism thereon for mating with a complementary electrical connector, while opposite free ends of said latching members are free to move upwardly and downwardly during the pivoting of said latching members;

locking latch means secured to each said latching member and being movable longitudinally along said latching members, said locking latch means being rotatable with said latching members, said locking latch means being movable to a first position where said latching members are pivotal in one sense allowing said latching mechanisms to move towards said body, but preventing said free ends from moving towards said body, and said locking latch means being movable to a second position allowing said latching members to pivot in an opposite sense, thereby allowing said free ends to move towards said housing, but preventing said latching mechanisms from moving towards said housing.

15. The electrical connector of claim 14, wherein said locking latch means comprises an upper wall extending over said latching members.

16. The electrical connector of claim 15, wherein said locking latch means further comprises front and rear bars extending below said latching members and flanking said hinge, and said locking latch members are movable between positions where said front and rear bars abut said hinge.

17. The electrical connector of claim 16, wherein said locking latch means further comprises sidewalls extending downwardly from said upper wall and flank side edges of said latching members, and said front and rear bars extend inwardly from said sidewalls.

18. An electrical connector comprising:

an insulative housing having a mating face and a wire connecting face;

latching members integrally connected to opposite side surfaces of said housing, said latching members being integrally connected via molded webs of material medially positioned between ends of said latching members thereby forming hinges for said latching members, one end of each said latching member having a latching mechanism thereon for mating with a complementary electrical connector, while opposite free ends of said latching members are free to move upwardly and downwardly during pivoting of said latching members;

locking latch means positioned adjacent to each said latching member, comprising sidewalls flanking each said latching members, said locking latch means having integral front and rear bars extending from said sidewalls, and an upper wall positioned in a plane above said bars, said upper wall being positioned above said latching member and said bars being positioned beneath said latching member, said front bars being positioned forward of said hinge and having spaced apart cantilever arms, each said arm extending integrally from an inner surface of said sidewalls, said rear bars being positioned behind said hinge, said locking latch means being adapted to move between first and second positions, where in said first position said cantilever arms abut said hinge and forward ends of said latching members are moveable towards said housing, and where in said second position said cantilever arms are moved forwardly preventing said forward ends of said latching members from moving towards said housing.

19. The electrical connector of claim 18, wherein said front cantilever arms have inner beveled side edges adapted for camming said sidewalls open upon insertion of said locking latch means over said latching members.

20. The electrical connector of claim 19 wherein said rear bars extend only part way between said sidewalls.

21. The electrical connector of claim 18, wherein said cantilever arms are substantially triangular in cross-section.

22. The electrical connector of claim 21, wherein said locking latch means are movable longitudinally along said latching members and pivotal with said latching members.

23. A panel mount electrical connector assembly, comprising:

a panel having at least one opening therethrough; and a connector member positioned in said opening, said connector comprising:

an insulative housing having a mating face and a wire connecting face;

latching members integrally connected to opposite side surfaces of said housing, said latching members being integrally connected via molded webs of material medially positioned between ends of said latching members thereby forming hinges for said latching members, a forward end of each said latching member having a latching mechanism thereon for mating with a complementary electrical connector, while opposite rearward free ends of said latching members are free to move upwardly and downwardly to pivot said latching members, said forward ends of each said latching members including rearwardly facing latching shoulders intermediate said latching mechanisms and said hinges;

locking means positioned adjacent to each said latching member, comprising an upper wall extending over said latching member, and spaced apart front bars positioned in a plane below said upper wall and positioned forward of said hinges, said locking means being movable from an unlocked position where said front bars abut said hinges to a locked position where said front bars are spaced forwardly of said hinges.

24. The electrical connector assembly of claim 23, wherein said locking means further comprises sidewalls extending downwardly from said upper wall, and said front bars extend integrally from inner surfaces of said sidewalls.

25. The electrical connector assembly of claim 24, wherein said locking means further comprises rear bars extending between said sidewalls of said locking means, the rear bars being spaced rearwardly of the hinges in the unlocked position and abutting the hinges in the locked position.

* * * * *